US009618874B2

(12) United States Patent
Miyadera

(10) Patent No.: US 9,618,874 B2
(45) Date of Patent: Apr. 11, 2017

(54) WRITE CONTROL APPARATUS, IMAGE FORMING APPARATUS, AND WRITE CONTROL METHOD

(71) Applicant: Tatsuya Miyadera, Kanagawa (JP)

(72) Inventor: Tatsuya Miyadera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/853,076

(22) Filed: Sep. 14, 2015

(65) Prior Publication Data

US 2016/0077460 A1 Mar. 17, 2016

(30) Foreign Application Priority Data

Sep. 17, 2014 (JP) ..... 2014-189298

(51) Int. Cl.
*H04N 1/04* (2006.01)
*G03G 15/043* (2006.01)
*G03G 15/041* (2006.01)

(52) U.S. Cl.
CPC ..... *G03G 15/043* (2013.01); *G03G 15/0415* (2013.01); *G03G 2215/0129* (2013.01)

(58) Field of Classification Search
CPC ..... G03G 15/043; G03G 15/0415; G03G 2215/0129
USPC ..... 358/524, 505, 474, 1.15
See application file for complete search history.

(56) References Cited

U.S. PATENT DOCUMENTS 7,715,769 B2 5/2010 Miyadera
7,805,100 B2 9/2010 Miyadera
7,986,907 B2 7/2011 Miyadera
8,004,546 B2 8/2011 Miyadera
8,026,937 B2 9/2011 Miyadera
8,035,667 B2 10/2011 Miyadera
8,170,455 B2 5/2012 Miyadera
8,369,725 B2 2/2013 Ohshima et al.
(Continued)

FOREIGN PATENT DOCUMENTS

JP 2006-259360 9/2006

OTHER PUBLICATIONS

U.S. Appl. No. 14/851,591, filed Sep. 11, 2015, Miyadera.
(Continued)

*Primary Examiner* — Houshang Safaipour
(74) *Attorney, Agent, or Firm* — Oblon, McClelland, Maier & Neustadt, L.L.P.

(57) ABSTRACT

A write control apparatus is for receiving one page worth of image data and performing processes, and writing an image by exposing a photoconductor. The write control apparatus includes a write control unit including a process function unit for performing the processes; a computer for generating setting values of parameters used by the process function unit; and first and second memories for storing the setting values. When the computer sends a trigger signal to start image formation to the write control unit, the second memory stores one page worth of the setting values stored in the first memory, and the setting values of a desired page among a plurality of pages worth of the setting values stored in the second memory are applied to operations by the process function unit when the write control unit controlled by the computer writes an image of the desired page.

15 Claims, 7 Drawing Sheets

(56) References Cited

U.S. PATENT DOCUMENTS

| | | | |
|---|---|---|---|
| 8,488,201 | B2 | 7/2013 | Miyadera et al. |
| 8,600,283 | B2 | 12/2013 | Kinoshita et al. |
| 8,638,481 | B2 | 1/2014 | Miyadera et al. |
| 8,654,419 | B2 | 2/2014 | Miyazaki et al. |
| 8,659,630 | B2 | 2/2014 | Komai et al. |
| 8,665,299 | B2 | 3/2014 | Miyadera et al. |
| 8,681,390 | B2 | 3/2014 | Takahashi et al. |
| 8,712,310 | B2 | 4/2014 | Shimizu et al. |
| 8,730,288 | B2 | 5/2014 | Miyadera |
| 8,744,293 | B2 | 6/2014 | Shirasaki et al. |
| 8,774,700 | B2 | 7/2014 | Shikama et al. |
| 8,781,343 | B2 | 7/2014 | Hayashi et al. |
| 8,823,760 | B2 | 9/2014 | Miyadera |
| 8,848,238 | B2 | 9/2014 | Miyadera et al. |
| 8,878,885 | B2 | 11/2014 | Miyadera |
| 8,879,969 | B2 | 11/2014 | Shikama et al. |
| 8,885,213 | B2 | 11/2014 | Yokoyama et al. |
| 8,917,303 | B2 | 12/2014 | Miyadera |
| 8,957,933 | B2 | 2/2015 | Shirasaki et al. |
| 9,013,532 | B2 | 4/2015 | Komai et al. |
| 9,019,551 | B2 | 4/2015 | Hayashi et al. |
| 9,036,198 | B2 | 5/2015 | Miyadera et al. |
| 9,041,756 | B2 | 5/2015 | Miyadera |
| 9,104,127 | B2 | 8/2015 | Yamaguchi et al. |
| 9,106,861 | B2 * | 8/2015 | Miyadera ..... H04N 1/3878 |
| 2010/0119273 | A1 | 5/2010 | Komai et al. |
| 2010/0239331 | A1 | 9/2010 | Miyadera et al. |
| 2012/0057889 | A1 | 3/2012 | Yamaguchi et al. |
| 2013/0004194 | A1 | 1/2013 | Shirasaki et al. |
| 2013/0044176 | A1 | 2/2013 | Shirasaki et al. |
| 2013/0207339 | A1 | 8/2013 | Yokoyama et al. |
| 2013/0242318 | A1 | 9/2013 | Yamaguchi et al. |
| 2014/0078521 | A1 | 3/2014 | Hayashi et al. |
| 2014/0139607 | A1 | 5/2014 | Hayashi et al. |
| 2014/0152754 | A1 | 6/2014 | Murakami et al. |
| 2014/0153042 | A1 | 6/2014 | Kawanabe et al. |
| 2014/0153943 | A1 | 6/2014 | Miyadera et al. |
| 2015/0139702 | A1 | 5/2015 | Murakami et al. |

OTHER PUBLICATIONS

U.S. Appl. No. 14/851,591, filed Sep. 11, 2015.
U.S. Appl. No. 14/632,188, filed Feb. 26, 2015.
U.S. Appl. No. 14/797,927, filed Jul. 13, 2015.

* cited by examiner

FIG.6

| LATCH TIMING | APPLY TIMING | ON/OFF | TARGET REGISTER |
|---|---|---|---|
| LATCH AT STOUT ASSERT IMMEDIATELY AFTER Start Trigger SETTING | APPLY AT STOUT ASSERT IMMEDIATELY AFTER Start Trigger SETTING | ALWAYS ON | MFSYNC SUB SCANNING DELAY AMOUNT SETTING REGISTER |
| LATCH AT STOUT ASSERT IMMEDIATELY AFTER Start Trigger SETTING | APPLY AT MFSYNC ASSERT OF CORRESPONDING PAGE | ON/OFF POSSIBLE | LATCH SIGNAL SUB SCANNING DELAY AMOUNT SETTING REGISTER |
| | | | DUMMY FGATE DELAY GENERATION ENABLE SETTING REGISTER |
| | | | DUMMY FGATE SUB SCANNING DELAY AMOUNT SETTING REGISTER |
| | | | MFSYNC MAIN SCANNING OUTPUT POSITION SETTING REGISTER |
| | | | MFSYNC OUTPUT ENABLE SETTING REGISTER |
| | | | MLSYNC OUTPUT NUMBER SETTING REGISTER |
| | | | MLSYNC MAIN SCANNING OFFSET AMOUNT SETTING REGISTER |
| | | | MLSYNC MAIN SCANNING OUTPUT INTERVAL SETTING REGISTER |

WRITE CONTROL APPARATUS, IMAGE FORMING APPARATUS, AND WRITE CONTROL METHOD

BACKGROUND OF THE INVENTION

1. Field of the Invention

The present invention generally relates to a write control apparatus and an image forming apparatus therewith, and a write control method.

2. Description of the Related Art

As an image forming apparatus including a printer, a copier, a facsimile machine, and a multifunction peripheral which has multiple functions thereof, an electrophotography type image forming apparatus is often used. In this type of image forming apparatus, in the case where images are continuously formed on multiple pages, productivity is increased by making a space between transfer sheets (between-sheets distance) as short as possible in order to speed up the image forming process.

Most of today's electrophotography type image forming apparatuses are digital. Digitized image data is processed by a write control apparatus and an exposure apparatus which has a light source such as a laser diode is operated. According to the exposure apparatus, a latent image is formed on a surface of a charged photoconductor by light writing. The electrostatic latent image is developed with toner. The toner image is directly, or via an intermediate transfer member, transferred onto a recording medium such as a transfer sheet. The transferred image is fixed on the recording medium by a fixing device.

In this type of image forming apparatus, in the case where images are continuously formed on multiple pages using various sizes of transfer sheets and using various image formation modes, parameters such as image formation conditions, etc., corresponding to the various sizes and various modes must be set for each page in a write control unit.

In a tandem image forming apparatus used for a color image forming apparatus, in a function of setting parameters in a write control unit from a CPU controlling an engine unit, in order to update the parameters between pages (between-pages period), a high processing speed is required. In order to achieve the high processing speed, a parameter control technique is known in which two sets of the same parameters are respectively set in two sets of registers and only a register selection signal is switched between the pages (double register system).

For example, Patent Document 1 discloses that, in a write control apparatus for writing image information onto paper, a storage unit for setting various parameters necessary for write control and a plurality of storage unit groups (registers) are provided, and the storage unit groups are switched according to print modes.

The parameter setting according to the above-described conventional double register system will be briefly described referring to FIG. 7.

In the system, registers a and registers b which have respective addresses and which have the same function are prepared. Further, for example, in (example 1) of FIG. 7, parameters for A4 size copy are set in the registers a, and parameters for A3 size copy are set in the register b. In (example 2), parameters for A4 size copy are set in the registers a, and parameters for A4 size printer are set in the registers b.

Arrows in FIG. 7 indicate a direction of transfer sheet flow (sub-scanning direction). Further, "copy" means an image formation mode for performing writing using image data read by a scanner from an original image, and "printer" means an image formation mode for performing writing using print data created by an external apparatus such as a personal computer.

Further, just before forming an image of a page whose page size or image formation mode is different, by controlling only a switching register which switches between the registers a and the registers b, registers to be applied to the image formation can be instantly selected.

For example, in (example 2) of FIG. 7, during an image formation of A4-printer in which parameters set in the registers b are applied, parameters for A4-copy are set in the registers a. Then, just before the start of image formation of A4-copy, by setting the switching register to the registers a, an image formation of A4-copy in which parameters set in the registers a are applied can be started.

In this kind of double register system, addresses of the registers a and the registers b are alternated.

In this kind of double register system, in the case of an abnormal end, it may become indefinite which of the registers a and the registers b are effective registers. As a result, at the time of the abnormal end, the switching register must be immediately updated to set one of the registers and the system should restart.

In the parameter control technique according to this kind of conventional double register system, a timing of setting the selection signal needs to be between pages. As a result, a process for monitoring a between-pages timing is needed. In the monitoring process, an active signal which indicates an image formation period and an interrupt signal which indicates an end of the image formation are detected by a CPU.

In order to perform this monitoring process, a high-speed processing function is demanded, such as connecting signal lines and completing the parameter setting process from when an interruption is detected to when the interval between pages (between sheets) ends, which makes the system complex.

Furthermore, in order to secure enough time for setting parameters, the space between pages needs to be increased, which decreases the productivity of the image forming apparatus.

Furthermore, the setting values of a plurality of the same parameters are stored, and therefore an enormous number of selection addresses of storage units need to be controlled from the CPU, which makes the system complex.

Patent Document 1: Japanese Laid-Open Patent Publication No. 2006-259360

SUMMARY OF THE INVENTION

The present invention provides a write control apparatus and an image forming apparatus therewith, and a write control method, in which one or more of the above-described disadvantages are eliminated.

According to an aspect of the present invention, there is provided a write control apparatus for receiving one page worth of image data, performing various processes on the received image data, controlling an exposure unit according to the processed image data, and writing an image by exposing a photoconductor, the write control apparatus including a write control unit configured to include a process function unit for performing the processes; a computer configured to generate setting values of various parameters used by the process function unit, and to control the write control unit; a first memory configured to store the setting values of the parameters generated by the computer; and a second memory configured to store one page worth of the setting values of the parameters stored in the first memory, the second memory being capable of storing a plurality of pages worth of the setting values, wherein when the computer sends a trigger signal indicating start of image formation to the write control unit, the second memory stores one page worth of the setting values stored in the first memory, and the setting values of a desired page among the plurality of pages worth of the setting values stored in the second memory are applied to operations by the process function unit when the write control unit controlled by the computer writes an image of the desired page.

According to an aspect of the present invention, there is provided a write control method performed by a write control unit controlled by a computer for receiving one page worth of image data, performing various processes on the received image data by process function units, controlling an exposure unit according to the processed image data, and writing an image by exposing a photoconductor, the write control method including generating, by the computer, setting values of various parameters used by the process function units and storing the generated setting values in a first memory; sending, by the computer, a trigger signal indicating start of image formation to the write control unit, and repeating to store, in a second memory, one page worth of the setting values of the parameters stored in the first memory, to store a plurality of pages worth of the setting values in the second memory; and applying the setting values of a desired page among the plurality of pages worth of the setting values stored in the second memory, to operations by the process function units when the write control unit writes an image of the desired page.

According to an aspect of the present invention, there is provided a write control apparatus for receiving one page worth of image data, performing various processes on the received image data, controlling an exposure means according to the processed image data, and writing an image by exposing a photoconductor, the write control apparatus including a write control means for including a process function means for performing the processes; an arithmetic control means for generating setting values of various parameters used by the process function means, and for controlling the write control means; a first storage means for storing the setting values of the parameters generated by the arithmetic control means; and a second storage means for storing one page worth of the setting values of the parameters stored in the first storage means, the second storage means being capable of storing a plurality of pages worth of the setting values, wherein when the arithmetic control means sends a trigger signal indicating start of image formation to the write control means, the second storage means stores one page worth of the setting values stored in the first storage means, and the setting values of a desired page among the plurality of pages worth of the setting values stored in the second storage means are applied to operations by the process function storage means when the write control storage means controlled by the arithmetic control means writes an image of the desired page.

BRIEF DESCRIPTION OF THE DRAWINGS

Other objects, features and advantages of the present invention will become more apparent from the following detailed description when read in conjunction with the accompanying drawings, in which:

FIG. 6 is a diagram indicating the latch timings and the apply timings of the data in the target register of the parameter setting values.

DETAILED DESCRIPTION OF THE PREFERRED EMBODIMENTS

A description is given, with reference to the accompanying drawings, of embodiments of the present invention.

Figure 1:
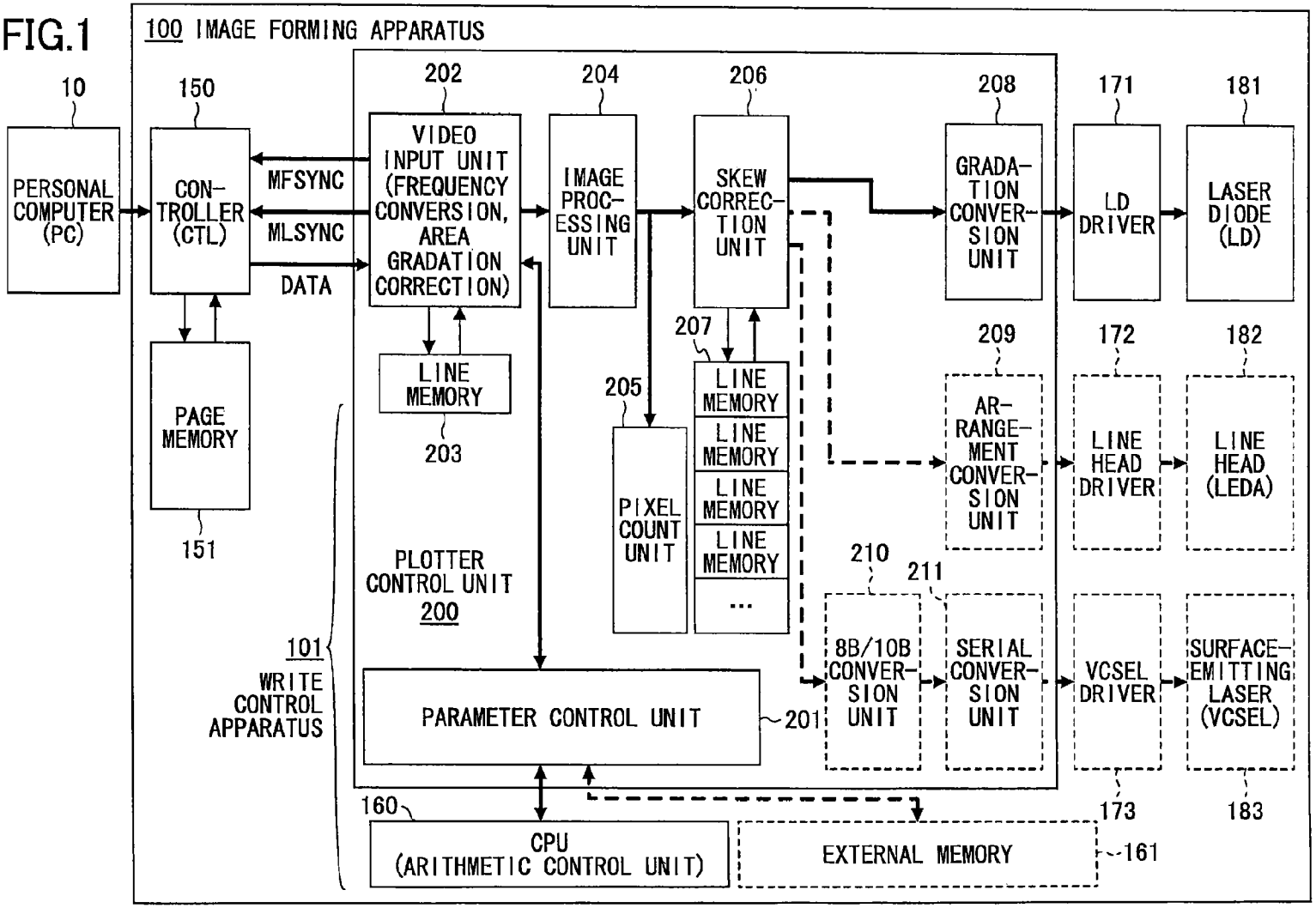
FIG. 1 is a block diagram illustrating an image forming apparatus including a write control apparatus according to an embodiment of the present invention.
Figure 2:
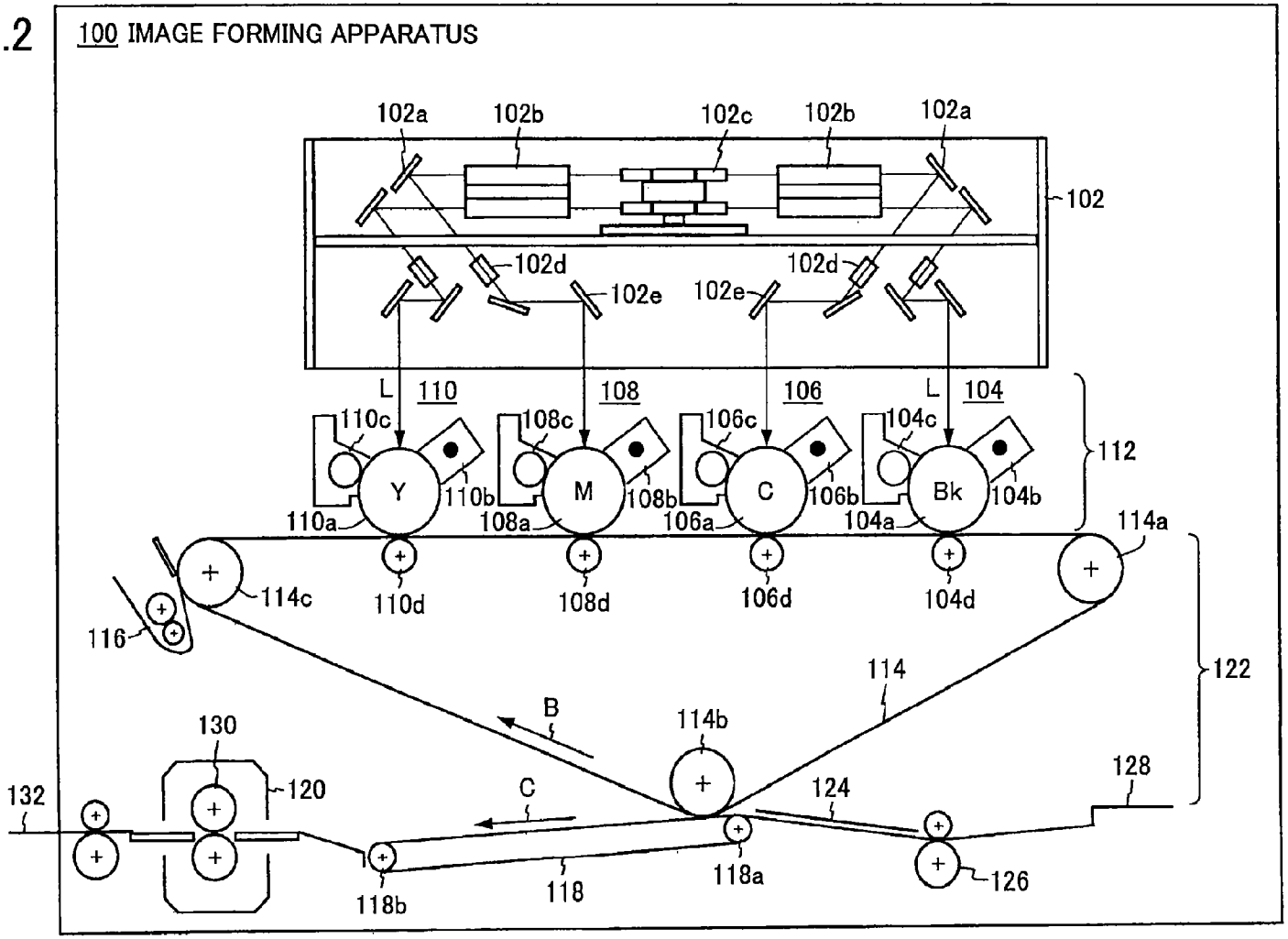
FIG. 2 is a schematic diagram illustrating an example of a mechanism part constituting an engine unit of the image forming apparatus.

FIG. 1 is a block diagram illustrating an image forming apparatus including a write control apparatus according to an embodiment of the present invention. FIG. 2 is a schematic diagram illustrating an example of a mechanism part constituting an engine unit of the image forming apparatus.

As illustrated in FIG. 1, an image forming apparatus 100 according to the present embodiment includes a controller (CTL) 150; a page memory 151; a plotter control unit 200, a CPU (arithmetic control unit) 160, etc., and a mechanism part illustrated in FIG. 2 which are included in an engine part. These elements constitute an image forming apparatus such as a tandem type digital color copier, a digital color multifunction peripheral, a color fax machine, and a color printer.

[Overview of Controller and Write Control Apparatus]

The controller 150 of FIG. 1 receives, via a network (not shown), print data that has been created by an external personal computer (hereinafter, "PC") 10, and generated by a printer driver installed in the PC. The print data is described in, for example, PDL (Page Description Language). Then, the controller 150 converts the print data into a colorplate (for example, bitmap data) of image data in units of pages constituted by pixels for the respective colors in the page memory 151, and transfers the colorplate to the plotter control unit 200 in units of lines.

The controller 150 includes a microcomputer constituted by a CPU, a ROM, a RAM, etc.

The plotter control unit 200 is a write control unit, and constitutes a write control apparatus 101 according to an embodiment of the present invention, together with the CPU 160 and/or an external memory 161.

The plotter control unit 200 that is a write control unit performs various processes by process function units on image data in units of pages transferred from the controller 150. Then, the plotter control unit 200 controls an exposure unit according to the processed image data, and writes an image by exposing a photoconductor described below, by the exposure unit.

That is, the plotter control unit 200 handles the image data transferred from the controller 150 as light emission data. The light source of the exposure unit is assumed to be a laser diode (LD) 181; however, a line head (LEDA) 182 or a surface-emitting laser (VCSEL) 183 in which LEDs are arranged in an array, may be used.

The plotter control unit 200 includes process function units such as a video input unit 202, a line memory 203, an image processing unit 204, a pixel count unit 205, a skew correction unit 206, a group of line memories 207, a gradation conversion unit 208, etc., and a parameter control unit 201.

Furthermore, instead of the gradation conversion unit 208, or together with the gradation conversion unit 208, an arrangement conversion unit 209 may be provided for using the line head 182 as a light source, and a 8B/10B conversion unit 210 and a serial conversion unit 211 may be provided for using the surface-emitting laser 183 as the light source. By providing all of these elements, the plotter control unit 200 is able to handle a model using any one of a laser diode, a line head, and a surface-emitting laser, as the light source used for light writing.

Note that the plotter control unit 200 has four channels (not shown) of channel 0 (ch0) through channel 3 (ch3), and the image data that is transferred from the controller 150 in units of lines for each page is input to a channel corresponding to each colorplate.

The laser diode 181 and a LD driver 171 driving the same, the line head 182 and a line head driver 172 driving the same, or the surface-emitting laser 183 and a VCSEL driver 173 driving the same, are also provided for each colorplate corresponding to one of the channels.

In the present embodiment, it is assumed that the image data of each colorplate is input to the corresponding channel, that is, yellow is input to ch0, magenta is input to ch1, cyan is input to ch2, and black is input to ch3; however, the present embodiment is not so limited. Yellow, magenta, and cyan are three primary colors used for forming a full color image by adding the colors, and correspond to the colors of toner when developing an electrostatic latent image.

Inside the plotter control unit 200, there is a parameter control unit 201, which stores the setting values of various parameters used in the respective process function units, and sends the setting values to the respective process function units. The parameter control unit 201 is connected to and controlled by the external CPU 160, and is able to rewrite the various parameters that are stored. Usually, an FF inside the parameter control unit 201 is used for storing the parameters; however, a memory such as SRAM, FIFO, or a non-volatile RAM may be used. This memory has areas corresponding to a first storage unit and a second storage unit described below. Furthermore, an external memory 161 may be connected to enlarge the storage area or to optimize the storage area for each model.

The CPU 160 is not merely a central processing unit, but is an arithmetic control unit used by a microcomputer including a ROM that is a program memory, a RAM that is a data memory, etc. This CPU 160 controls the function units inside the plotter control unit 200 including the parameter control unit 201, and also controls the entire engine part including the mechanism part described below with reference to FIG. 2.

Thus, the CPU 160 is not only connected to the video input unit 202, but also to all of the function units such as the image processing unit 204, the pixel count unit 205, the skew correction unit 206, the gradation conversion unit 208, etc., via the parameter control unit 201. However, the connection lines are not shown in the figure.

The write control apparatus 101 according to an embodiment of the present invention is constituted by the plotter control unit 200 and the CPU 160, and/or the external memory 161. The CPU 160, which is an arithmetic control unit, generates setting values of various parameters used in the process function units in the plotter control unit 200 that is a write control unit, and also controls the entire plotter control unit 200.

The setting values of various parameters generated by the CPU 160 are stored in the first storage unit inside the parameter control unit 201.

The second storage unit inside the parameter control unit 201 stores the setting values stored in the first storage unit in units of pages, and is able to store a plurality of pages worth of the setting values.

When the CPU 160 sends a trigger signal indicating the start of image formation to the plotter control unit 200, the second storage unit stores one page worth of the setting values stored in the first storage unit. Subsequently, the setting values of a desired page among the setting values of a plurality of pages stored in the second storage unit, are applied to the operations of the process function units such as the video input unit 202 when writing images of the page by the plotter control unit 200 of controlled by the CPU 160.

When a print operation is instructed from the PC 10, the image data is transferred to the controller 150 via the printer driver in the PC 10. In the controller 150, the image data is converted into bitmap data in the page memory 151, and image data in units of pages is transferred to the video input unit 202 of the plotter control unit 200.

In the plotter control unit 200, frame synchronization signals MFSYNC and line synchronization signals MLSYNC are output from the video input unit 202 to the controller 150. The frame synchronization signals MFSYNC are synchronization signals of a pulse type indicating the tip of the page and the line synchronization signals MLSYNC are synchronization signals of a pulse type indicating the tip of the line.

The controller 150 transfers the image data (DATA) to the video input unit 202 after frame synchronization signals MFSYNC are input, in synchronization with the input timing of the line synchronization signals MLSYNC.

Therefore, the frame synchronization signals MFSYNC are also image transfer request signals.

This transfer format includes an image forming method by which formats that are different according to the respective colorplates can be processed, and an image forming method by which only a format common to the colorplates can be processed.

The "image forming method by which only a format common among the colorplates can be processed" is a system in which the main scanning control signals (MLSYNC and LGATE) that are exchanged by the controller 150 and the plotter control unit 200, are common to the colors. Therefore, this image forming method has a small number of connection signal lines and a small setting amount, and therefore the system can be simplified.

Figure 7:
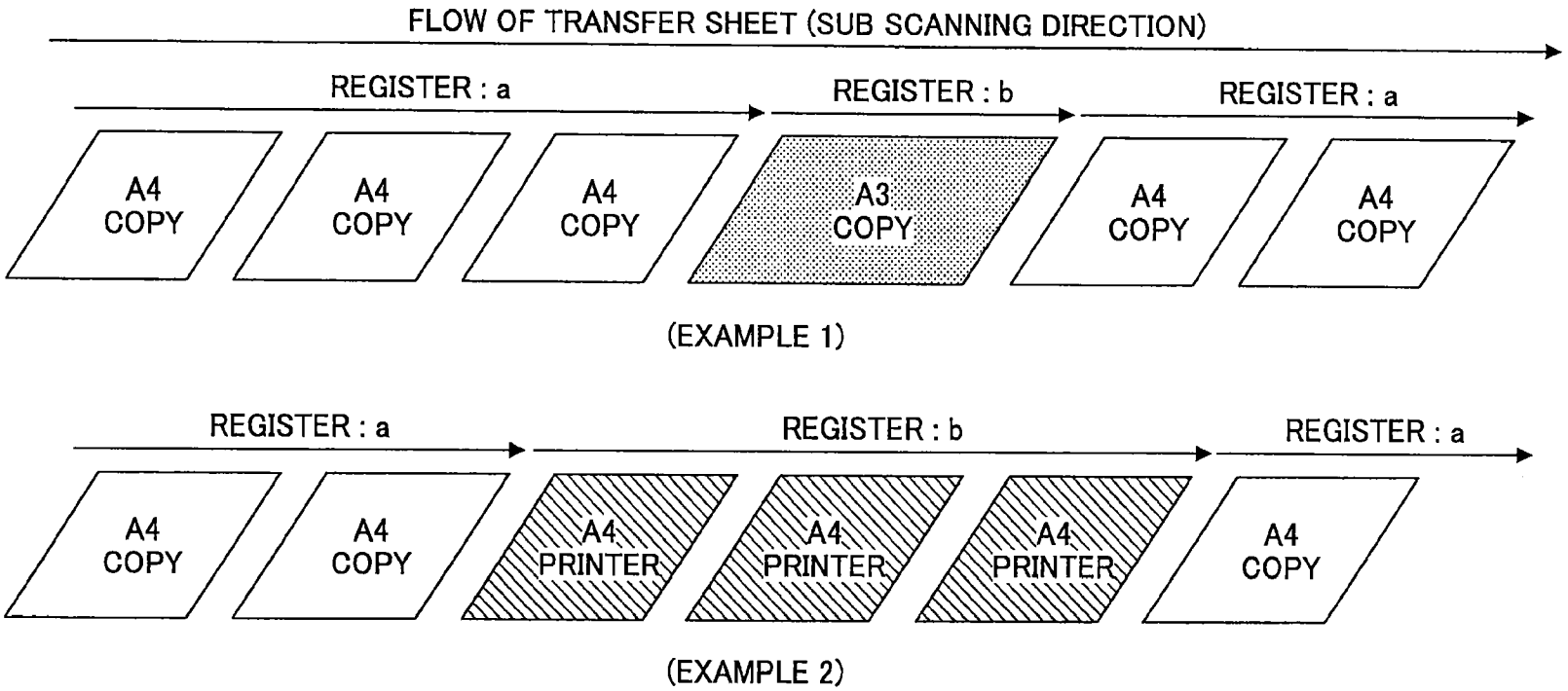
FIG. 7 illustrates an example of parameter setting by a convention double register system.

However, for example, when switching from A4 printing to A3 printing, until the image formation station at the last stage completes A4 printing, the leading station is unable to start A3 printing. Therefore, mixed printing as illustrated in FIG. 7 cannot be performed, and the productivity is decreased.

The "image forming method by which formats that are different according to the respective colorplates can be processed" is a system in which the main scanning control signals (MLSYNC and LGATE) that are exchanged by the controller 150 and the plotter control unit 200, are different according to the respective colors. Therefore, this image forming method has an increased number of connection signal lines and an increased setting amount; however, it is possible to perform the mixed printing as illustrated in FIG. 7 and the productivity is increased.

As a matter of course, the present invention is preferably applied to the "image forming method by which formats that are different according to the respective colorplates can be processed".

The video input unit 202 is a process function unit that acts as an interface between the plotter control unit 200 and the controller 150; however, the plotter control unit 200 has a different operation clock frequency from that of the controller 150. Therefore, the transferred image data is temporarily stored in the line memory 203, and frequency conversion is performed for image data read based on the operation clocks of the plotter control unit 200. Subsequently, an internal pattern is added and image processing such as a trimming process is performed, and the image data is transferred to the image processing unit 204 in units of lines.

Note that when performing image processing at the video input unit 202, when a process that requires a line memory such as jaggy correction is performed, a line memory for image processing is included.

Furthermore, when writing is performed by using the line head 182 as the light source (LEDA writing), area gradation correction is also performed. This is to implement control for realizing area gradation by taking advantage of the LEDA being binary-driven and having a high resolution in a sub-scanning direction, and the area gradation is realized by converting one pixel into a plurality of lines in the sub scanning direction and partially switching off the lines.

This correction is preferably performed immediately after converting into high resolution in the sub scanning direction. Therefore, the video input unit 202 converts the input image into high resolution in the sub scanning direction at the time of LEDA writing, and immediately after this, area gradation correction is performed.

The image processing unit 204 performs image processing on the image data input in units of lines from the video input unit 202, and transfers the image data to the skew correction unit 206 in units of lines.

The image processing unit 204 can generate test patterns and anti-counterfeiting patterns to be superimposed on the image data transferred from the video input unit 202, and adjustment patterns generated by the plotter control unit 200 alone. Therefore there are three types of adjustment patterns: a density adjustment pattern, a color shift adjustment pattern, and a pattern for preventing a blade from being ridden up (a photoconductor total exposure pattern).

The skew correction unit 206 sequentially stores the image data transferred from the image processing unit 204 in a plurality of line memories of the group of line memories 207 for skew correction, and performs a skew correction process by reading the image data while switching the line memory to be the read target according to the image position.

It is possible to perform frequency conversion by write and read of the group of line memories 207 for skew correction.

The pixel count unit 205 measures the data amount of the data that has undergone image processing by the image processing unit 204. Here, it is possible to count the pixels of the test patterns and anti-counterfeiting patterns to be superimposed on the transferred image data, and adjustment patterns generated by the plotter control unit 200 alone, and therefore it is possible to obtain the pixel information that is closest to the toner consumption amount. However, when writing images by using the laser diode 181 as the light source, the toner consumption amount per pixel further changes by gradation conversion at the gradation conversion unit 208. Therefore, pseudo-gradation conversion is to be performed on the image data input to the pixel count unit 205.

When performing the skew correction at the skew correction unit 206, by making the line frequency during a read process 1/N (N is a natural number) of the line frequency during a write process, the data can be read N times from one line of memory, and thereby, the data after the skew correction become high density data in which the resolution in the sub-scanning direction is N times the resolution during the write process (double density process).

The light emission data that is image data that has undergone the skew correction and the double density process at the skew correction unit 206, is transferred as follows according to the optical system used for transmission.

Here, the optical system using the laser diode 181 as the light source for light writing is referred to as an LD optical system, the optical system using the line head 182 as the light source for light writing is referred to as a line head optical system, and the optical system using the surface-emitting laser 183 as the light source for light writing is referred to as an VCSEL optical system.

LD Optical System

The laser diode 181 is capable of emitting multi-level data light by using PWM modulation (time division lighting time control using a high-speed clock). Therefore, after the light emission data is transferred to the gradation conversion unit 208 and undergoes gradation conversion, the data is transferred to the LD driver 171 outside the plotter control unit 200. Accordingly, the LD driver 171 causes the laser diode 181 to emit light according to the light emission data, and performs light writing. Note that there are laser diodes (LD) such as single LD, multi LD, LD array, etc.

Line Head Optical System

According to the dot arrangement of a line head, there is a need to convert the data arrangement according to the wiring. Therefore, after the light emission data is transferred to the arrangement conversion unit 209 and undergoes arrangement conversion, the light emission data is transferred to the line head driver 172 outside the plotter control unit 200. Accordingly, the line head driver 172 causes the line head 182 to emit light according to the light emission data, to perform light writing. When the arrangement conversion by the arrangement conversion unit 209 extends across an entire line, a line memory group is arranged here also, and the image data, which has undergone a skew correction process at the skew correction unit 206, is sequentially stored in the line memory group, and then the data that has undergone arrangement conversion is lead. As the line head, there is a line head using an organic EL, other than a light emission diode array (LEDA).

VCSEL Optical System

The light emission data is transferred to the 8B/10B conversion unit 210, and the light emission data is subjected to data conversion, and a symbol code is added to the light emission data. The data that has been converted from 8 bits to 10 bits at the 8B/10B conversion unit 210, is converted into serial data at the serial conversion unit 211, and is then transferred to the VCSEL driver 173 outside the plotter control unit 200. At the VCSEL driver 173, the light emission data is converted again to the original 8 bit data, and the surface-emitting laser (VCSEL) 183 emits light based on the re-converted 8 bit data, to perform light writing.

[Mechanism Part of Image Forming Apparatus]

FIG. 2 illustrates an example of the mechanism part constituting the engine part of the image forming apparatus 100, which is a digital color image forming apparatus of a tandem intermediate transfer type, including an exposure device using the LD optical system.

The engine part of the image forming apparatus 100 includes an exposure device 102, a tandem color image formation unit 112, a transfer unit 122 including an intermediate transfer belt 114 that is an endless intermediate transfer medium, etc.

The exposure device 102 is an exposure means, which includes optical elements such as laser diodes as the four light sources and a polygon mirror. The tandem color image formation unit 112 includes image formation process units (image forming units) 110, 108, 106, 104 for the respective colors of yellow (Y), magenta (M), cyan (C), and black (Bk).

The image formation process units 110, 108, 106, 104 of the tandem color image formation unit 112 respectively include drum type photoconductors that are image bearers (hereinafter, "photoconductive drums") 110*a*, 108*a*, 106*a*, 104*a*. Charging devices 110*b*, 108*b*, 106*b*, 104*b*, developing devices 110*c*, 108*c*, 106*c*, 104*c*, and primary transfer rollers 110*d*, 108*d*, 106*d*, 104*d* are arranged around the photoconductive drums 110*a*, 108*a*, 106*a*, 104*a*, respectively.

The exposure device 102 that is an exposure means is a multi-beam scanning device in the present embodiment.

Four laser beams that are emitted from the laser diodes of the four light source units (not shown) are deflected by a two-stage polygon mirror 102*c* that is a deflecting device, such that the laser beams enter an fθ lens 102*b*. The laser beams respectively correspond to the colors of Y, M, C, and Bk. After the laser beams pass through the fθ lens 102*b*, the laser beams are reflected by a reflective mirror 102*a*.

After the laser beams are shaped as they pass through a WTL lens 102*d*, the laser beams are deflected again by a plurality of reflective mirrors 102*e*, and the laser beams become laser beams L used for exposure. The scan target surfaces (hereinafter, simply referred to as "surfaces") of the photoconductive drums 110*a*, 108*a*, 106*a*, 104*a* of the image formation process units 110, 108, 106, 104 are irradiated with and exposed by the laser beams L.

The irradiation of the laser beams L onto the surfaces of the photoconductive drums 110*a*, 108*a*, 106*a*, 104*a* is performed by using a plurality of optical elements as described above, and therefore timing synchronization is performed with respect to the main scanning direction and the sub scanning direction.

Note that "main scanning direction" is defined as the scanning direction of the laser beams and the "sub scanning direction" is defined as a direction orthogonal to the main scanning direction, i.e., in this image forming apparatus 100, this is defined as the direction in which the photoconductive drums 110*a*, 108*a*, 106*a*, 104*a* rotate, that is, the direction of movement of the surfaces of these photoconductive drums.

The photoconductive drums 110*a*, 108*a*, 106*a*, 104*a* include a photoconductive layer including at least an electric charge generating layer and an electric charge transporting layer, on a conductive drum made of aluminum, etc.

The photoconductive layers are charged as surface electric charges are applied by the charging devices 110*b*, 108*b*, 106*b*, 104*b* constituted by a corotron, a scorotron, or a charging roller. The surfaces of the charged photoconductive layers of the photoconductive drums 110*a*, 108*a*, 106*a*, 104*a* are exposed by the laser beams L from the exposure device 102 according to image data, and two-dimensional electrostatic latent images are formed (image writing is performed).

Note that the electrostatic latent images and toner images described below are formed in the order of Y, M, C, and Bk in the present embodiment.

The electrostatic latent images formed on the surfaces of the photoconductive drums 110*a*, 108*a*, 106*a*, 104*a* are developed with toner that is developers of the colors of Y, M, C, and Bk by the corresponding developing devices 110*c*, 108*c*, 106*c*, 104*c*, and toner images of the respective colors are formed.

The toner images of the respective colors are sequentially transferred so as to be superimposed on each other in the order of Y, M, C, and Bk, on the intermediate transfer belt 114 that moves in the arrow B direction, at the primary transfer parts, which are where the photoconductive drums 110*a*, 108*a*, 106*a*, 104*a* face the primary transfer rollers 110*d*, 108*d*, 106*d*, 104*d* across the intermediate transfer belt 114.

A transfer bias voltage is applied to the primary transfer rollers 110*d*, 108*d*, 106*d*, 104*d*.

The intermediate transfer belt 114 is stretched across conveying rollers 114*a*, 114*b*, 114*c*, and is rotated in the arrow B direction by either one of the conveying roller 114*a* or the conveying roller 114*c* which is a driving roller.

On the surface of the intermediate transfer belt 114, toner images of Y, M, C, and Bk are transferred and superimposed, such that a full color toner image is formed. The full color toner image carried on the intermediate transfer belt 114 is conveyed to the secondary transfer part.

The secondary transfer part includes a secondary transfer belt 118 that is conveyed in the arrow C direction by conveying rollers 118*a*, 118*b*. The conveying roller 114*b* of the intermediate transfer belt 114 also has a function of a secondary transfer opposite roller.

To the secondary transfer part, a sheet-type recording medium 124 such as high-quality paper and a plastic sheet is supplied from a recording medium accommodating unit 128 such as a sheet feeding cassette, by a conveying roller 126.

Then, a secondary transfer bias is applied to the conveying roller 114*b* also having the role of a secondary transfer opposite roller, such that the full-color toner image carried on the intermediate transfer belt 114 is transferred onto the recording medium 124 that is held and adsorbed on the secondary transfer belt 118.

The recording medium 124 on which the full-color toner image has been transferred, is conveyed to a fixing device 120 by moving in an arrow C direction of the secondary transfer belt 118.

The fixing device 120 includes a fixing roller 130 including silicon rubber, fluorine-containing rubber, etc. The fixing device 120 applies pressure and heat on the recording medium 124 on which the toner image has been transferred, to fix the toner image onto the recording medium 124. Subsequently, the recording medium 124 is discharged outside the image forming apparatus 100 as printed matter 132.

The intermediate transfer belt 114 after transferring the toner image is cleaned by a cleaning unit 116 including a cleaning blade, such that the residual toner after the transfer is removed, to be prepared for the next image forming process.

[Overview of Parameter Setting]

In the present embodiment, the tandem image forming apparatus as described above has a feature in that the CPU 160 illustrated in FIG. 1 has a function of setting parameters of the respective colors and respective pages, in the respective units in the plotter control unit 200.

In summary, a register (parameter storage unit) managed by a single address is used, and parameter setting values of all colors stored in the register corresponding to one page are stored in another storage area, in response to setting of a start trigger signal that is an operation start signal common to all image formation colors. Then, by the next setting of a start trigger signal, the parameter setting values for the next one page are stored, while holding the stored parameter setting values of the previous page. The storage area is capable of storing a plurality of pages worth of parameter setting values, and at the image forming start timings of the colors of the corresponding page, the parameter setting values are automatically applied to the write control by one page and one color at a time.

An overview of this feature is described in detail with reference to FIGS. 1 and 3.

Figure 3:
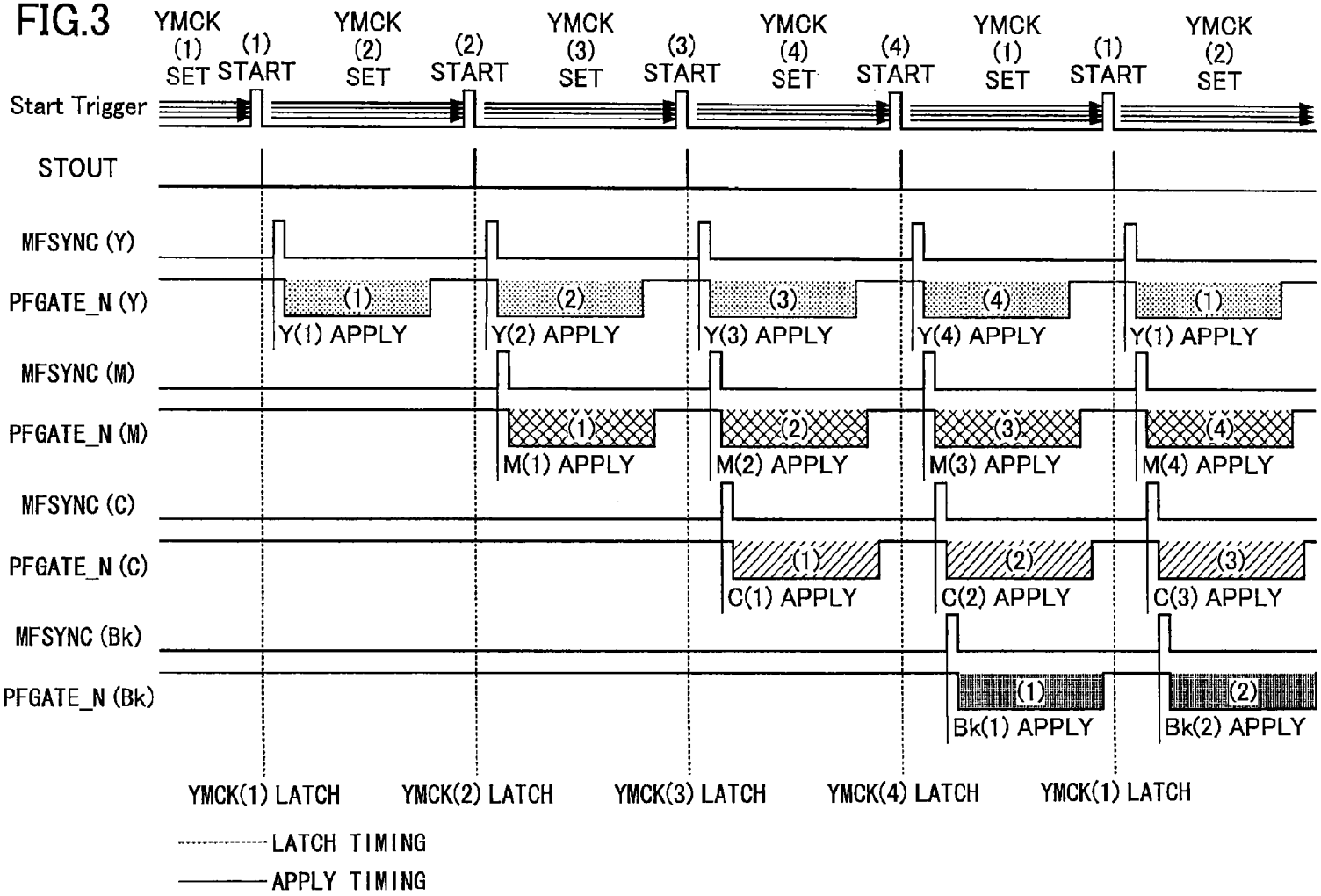
FIG. 3 is a timing chart for describing parameter settings by a start trigger latch system in the image forming apparatus illustrated in FIGS. 1 and 2.

FIG. 3 is a timing chart for describing parameter settings by a start trigger latch system in the image forming apparatus illustrated in FIGS. 1 and 2.

In FIG. 3, Y denotes yellow, M denotes magenta, C denotes cyan, and Bk denotes black, and this is an example of forming a color image by these four colors. Furthermore, (1) through (4) mean the first page through the fourth page, respectively, when the number of pages that can be arranged in the interval from the leading image formation color (Y) to the last image formation color (Bk), is four pages.

In the start trigger latch system, when a start trigger signal (Start Trigger) is set by the CPU 160 illustrated in FIG. 1, one page worth of parameter setting values are stored in the second storage unit, which have been stored (set) in the first storage unit by the CPU 160 up to that time.

Then, when the plotter control unit 200 writes an image of the corresponding page, the setting values of the page stored in the second storage unit are applied to the operations of the process function unit (in this example, mainly the video input unit 202).

The above process may be performed at the time of the asserting of an external trigger signal STIN_N, instead of the start trigger signal. However, in the following description, it is assumed that the process is performed when the start trigger signal is set, that is, when the CPU 160 sends a start trigger signal to the plotter control unit 200.

A start trigger signal is a trigger signal that is the starting point of starting image The start trigger signals are asynchronous formation by all function units of the plotter control unit 200 of the respective channels. signals for the respective function units such as the parameter control unit 201, the video input unit 202, etc., in the plotter control unit 200, and therefore STOUT signals are generated, which are synchronized at the video input unit 202. The synchronized STOUT signals are set near the center of the line frequency of all colors, such that the synchronized STOUT signals do not cause color shift.

The line frequencies of the respective colors have a phase difference of ½ line at maximum, and therefore the asserting of the STOUT signal becomes delayed from the asserting of the start trigger signal by one line at maximum.

The CPU 160 stores and sets, in the registers of the first storage unit of the respective colors, the parameter setting values for the colors Y, M, C, and Bk of the next page, from when a STOUT signal is asserted by the video input unit 202 to when the start trigger signal of the next page is sent. This period is indicated at the topmost part of FIG. 3, by four arrows for four colors between the start trigger signals (Start Trigger).

When the CPU 160 sends the start trigger signal for the next page, and the video input unit 202 asserts the STOUT signal, one page worth of the parameter setting values for each color stored in the first storage unit for each color, are stored in the second storage unit for each color.

Then, after the video input unit 202 of the plotter control unit 200 of each channel asserts MFSYNC, when creating and writing the images of the respective colors of the corresponding page (image formation), the setting values of the page stored in the second storage units of the respective colors are applied to the operation of the process function units.

MFSYNC (Y), (M), (C), (Bk) are trigger signals for starting the image formation of each color of each page, and PFGATE_N (Y), (M), (C), (Bk) are signals indicating that the images of the respective colors are being formed.

The dashed lines in FIG. 3 indicate latch timings for storing the parameter setting values stored in the first storage unit, into the second storage unit. The thin lines indicate the application timings of applying the setting values of the corresponding page stored in the second storage unit, to the operations of the process function units by the plotter control unit 200.

Image formation is started from the first page (1) of yellow (Y), and the first page (1) of magenta (M) is started at the same time as the second page (2) of yellow (Y). Subsequently, at the same time as the third page (3) of yellow (Y), the second page (2) of magenta (M) and the first page (1) of cyan (C) are started at the same time. Next, at the same time as the fourth page (4) of yellow (Y), the third page (3) of magenta (M), the second page (2) of cyan (C), and the first page (1) of black (Bk) are started at the same time. Subsequently, the image formation operations of the pages are performed at the same time, in which the pages of yellow, magenta, cyan, and black are shifted by one page each.

Accordingly, on the intermediate transfer belt 114 illustrated in FIG. 2, a color image is formed on each page as the toner images of yellow, magenta, cyan, and black are sequentially transferred and superimposed.

[Detailed Description of Embodiment]

In the following, details of an embodiment of the present invention described above are described with reference to FIGS. 4 through 6.

Figure 4:
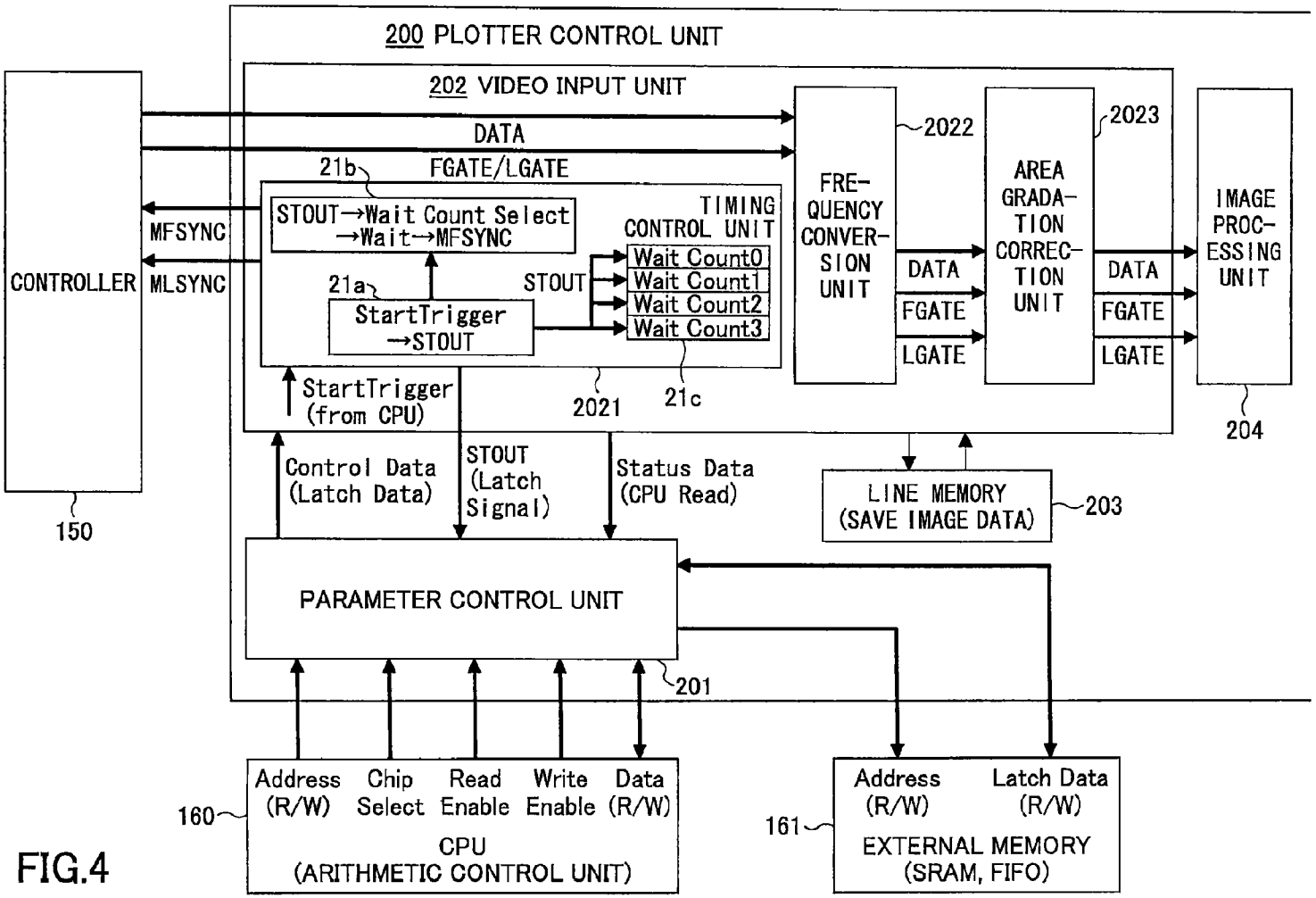
FIG. 4 is a block diagram illustrating main parts and relevant parts of a plotter control unit illustrated in FIG. 1.
Figure 5:
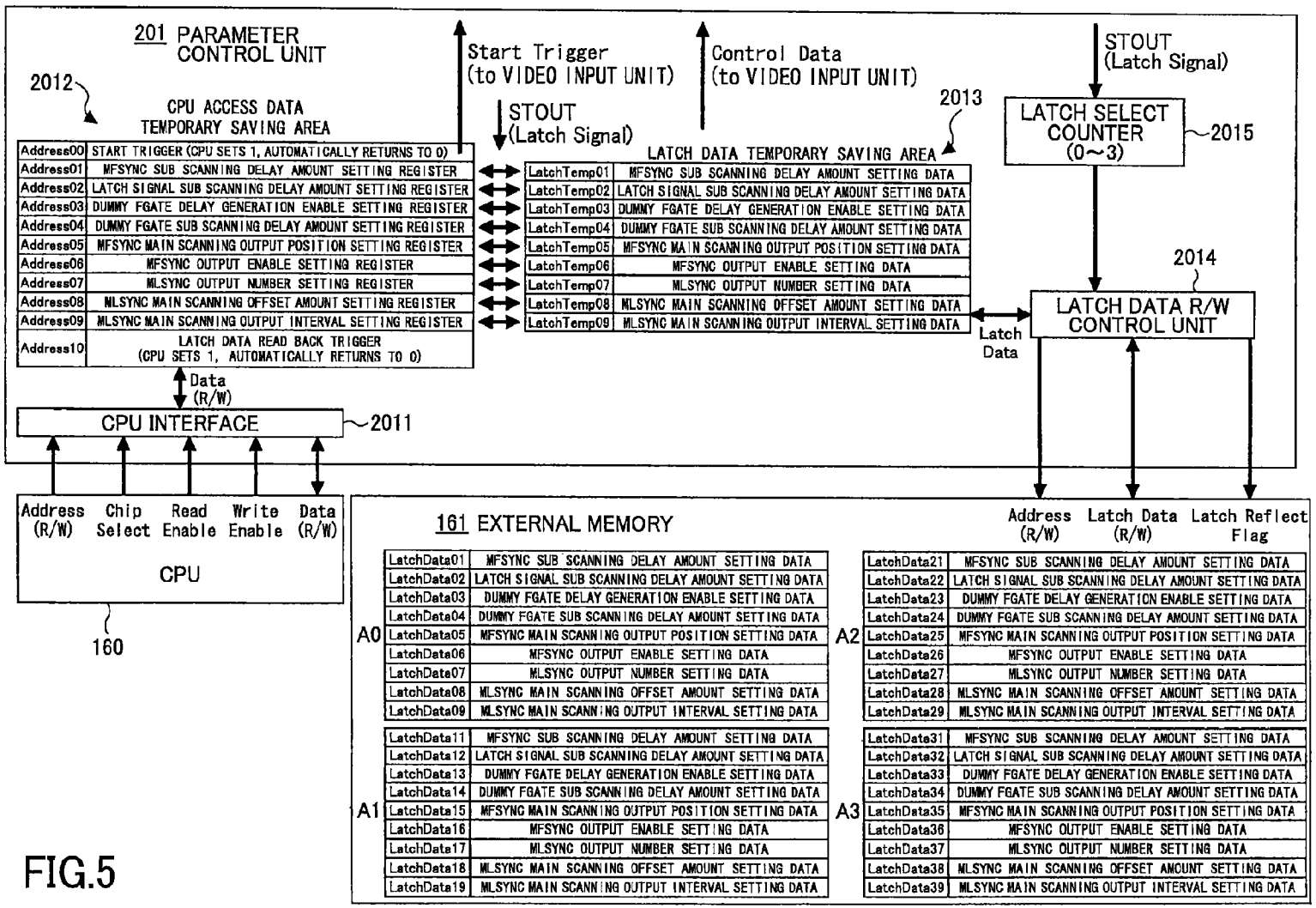
FIG. 5 is a block diagram illustrating an example of stored parameter setting values in the parameter control unit and the external memory.

FIG. 4 is a block diagram illustrating main parts and relevant parts of the plotter control unit 200 illustrated in FIG. 1. FIG. 5 is a block diagram illustrating an example of stored parameter setting values in the parameter control unit 201 and the external memory 161. In FIGS. 4 and 5, the parts corresponding to FIG. 1 are denoted by the same reference numerals. The plotter control unit 200 and the external memory 161 are provided for each of the four channels of the respective colors of yellow, magenta, cyan, and black. FIG. 6 is a diagram indicating the latch timings and the apply timings of the data in the target register of the parameter setting values.

The video input unit 202 inside the plotter control unit 200 of FIG. 4 includes a timing control unit 2021, a frequency conversion unit 2022, and an area gradation correction unit 2023.

The timing control unit 2021 includes a STOUT signal generating unit 21*a*, an MFSYNC generating unit 21*b*, and a wait time (wait) managing unit 21*c*.

The STOUT signal generating unit 21*a* generates a STOUT signal by synchronizing a start trigger signal (Start Trigger) from the CPU 160 as described above.

The wait time (wait) managing unit 21*c* is constituted by four counters, Wait Count0 through Wait Count3. Each counter is for managing the time from when each page (1)

through (4) in FIG. 3 starts, to when the setting values of each page for each color are applied.

Wait Count 0: manages time from "(1) Start" until "(1) Apply" for each color Wait Count 1: manages time from "(2) Start" until "(2) Apply" for each color Wait Count 2: manages time from "(3) Start" until "(3) Apply" for each color Wait Count 3: manages time from "(4) Start" until "(4) Apply" for each color In an example shown in FIG. 3, operations are performed on pages in the order of (1)->(2)->(3)->(4)->(1) - - - , that is, (1)-(4)->(1)-(4), repeatedly. The above operation is referred to as "toggle operation".

In accordance with the above operation, in the wait time (wait) managing unit 21*c*, each time a STOUT signal is input from the STOUT signal generating unit 21*a*, a toggle operation is performed as follows: Wait Count 0->Wait Count 1->Wait Count 2->Wait Count 3->Wait Count 0 - - - .

When a STOUT signal is input from the STOUT signal generating unit 21*a*, the MFSYNC generating unit 21*b* selects the counter of the wait time managing unit 21*c* which has just been switched. Then, after waiting the time controlled by the counter, the MFSYNC generating unit 21*b* generates a frame synchronization signal MFSYNC. The frame synchronization signal MFSYNC is a trigger signal for starting image formation of each color of each page. In the video input unit 202, a line synchronization signal MLSYNC is also generated, which is a trigger signal for starting to write each line of each page.

Further, the video input unit 202 outputs the frame synchronization signal MFSYNC and the line synchronization signal MLSYNC to the controller 150, thereby, after the frame synchronization signal MFSYNC is input, at the input timing of the line synchronization signal MLSYNC, the controller 150 transfers the image data DATA to the video input unit 202.

At this time, the controller 150 also sends a frame gate signal FGATE and a line gate signal LGATE to the video input unit 202, and FGATE and LGATE together with the image data DATA are input to the frequency conversion unit 2022.

An operation clock frequency of the plotter control unit 200 is different from an operation clock frequency of the controller 150. Therefore, the frequency conversion unit 2022 performs a frequency conversion in which the frequency conversion unit 2022 temporarily stores the image data DATA which has been transferred from the controller 150 in the line memory 203, and in accordance with the operation clock of the video input unit 202, that is, of the plotter control unit 200, reads the image data.

Also, in the case of write which uses the line head 182 as a light source (LEDA write), the image data (DATA) is sent to the image processing unit 204 after an area gradation correction is also performed by the area gradation correction unit 2023. This is a control method for realizing an area gradation by taking advantage of the LEDA which is binary driven and has a high resolution in a sub-scanning direction; specifically, the control method is performed by converting one pixel to multiple lines in the sub-scanning direction and by partially turning off the lines.

However, in the case other than the LEDA write, the area gradation correction unit 2023 is not operated, and input image data DATA is output as it is to the image processing unit 204.

Together with the image data DATA, the frame gate signal FGATE and the line gate signal LGATE are also sent from the frequency conversion unit 2022 to the image processing unit 204 through the area gradation correction unit 2023. Descriptions of the process function units beyond image processing unit 204 are omitted herein.

The video input unit 202 sends a STOUT signal to the parameter control unit 201. The parameter control unit 201 reads the status data (Status Data) by the control of the CPU 160, and takes in the control data (Control Data) by the parameter setting values.

The parameter control unit 201 receives, from the CPU (arithmetic control unit) 160, the address signal (Address R/W) for reading and writing, and a chip select signal (Chip Select). Furthermore, the parameter control unit 201 receives a read enable signal (Read Enable) or a write enable signal (Write Enable), and reads and writes data (Data R/W) between the CPU 160.

Furthermore, in the present embodiment, the external memory 161 is connected to the parameter control unit 201, and an address signal (Address R/W) is sent from the parameter control unit 201 to the external memory 161, and latch data (Latch Data R/W) is read and written.

The CPU 160 controls all process function units in the plotter control unit 200, and therefore the process function unit to be the control target is selected by a chip select signal; however, descriptions other than the parameter control unit 201 and the video input unit 202 are omitted herein.

Next, a description is given of a specific example of parameter setting in the present embodiment, with reference to FIG. 5. FIG. 5 is a block diagram illustrating a storage example of parameter setting values in the parameter control unit 201 and the external memory 161.

In the parameter control unit 201, a CPU interface 2011, a CPU access data temporary saving area 2012, a latch data temporary saving area 2013, a latch data R/W control unit 2014, and a latch select counter 2015 are provided.

The CPU access data temporary saving area 2012 is a first storage unit for storing setting values of various parameters generated by the CPU 160. The latch data temporary saving area 2013 is a second storage unit for storing one page worth of setting values stored in the first storage unit. As these storage units, a memory such as a SRAM, a FIFO, a non-volatile RAM, etc., is used.

The external memory 161 also constitutes the second storage unit, and is a memory such as a SRAM, a FIFO, a non-volatile RAM, etc. The external memory 161 includes four latch data saving areas A0 through A3, each having the same storage capacity as the latch data temporary saving area 2013.

The signals and data from the CPU 160 are input to the parameter control unit 201 through the CPU interface 2011, to control these respective units and also to control the respective process function units from there.

In this example, the CPU access data temporary saving area 2012 includes eleven storage areas (registers), having addresses 00 through 10. The CPU 160 can directly accesses these storage areas, and read and write data.

The address 00 is a register of a start trigger. When the CPU 160 sets "1", a start trigger signals is asserted, and the start trigger signal is sent to the timing control unit 2021 of the video input unit 202 described above. Subsequently, the address 00 immediately automatically returns to "0".

The addresses 01 through 09 are the next registers, and in each register, one page worth of setting values (data/information) of the next parameters used by the video input unit 202, are written in and stored by the CPU 160, and are temporarily saved.

Address 01: MFSYNC Sub Scanning Delay Amount Setting Register

An initial value of a down counter MFCOUNT that manages the time from the reception of a start trigger signal to the asserting of the frame synchronization signal MFSYNC of each color. By changing this value according to the colors, it is possible to form a color image by superimposing images of a plurality of colors at the same position on a page.

Address 02: Latch Signal Sub Scanning Delay Amount Setting Register

A value for determining the generation delay time of the latch timing signal from a standard timing, when there is a system of latching and applying a setting value for each page, other than a start trigger latch. The standard timing is the asserting of the frame synchronization signal MFSYNC.

Address 03: Dummy FGATE Delay Generation Enable Setting Register

When performing image formation by monochrome printing or without receiving image data from the controller 150, the transmission of the frame synchronization signal MFSYNC to the controller 150 is masked.

That is, this is an operation of forming images only by the plotter control unit 200, without images being transferred from the controller 150. For example, there is a function of printing by two colors to save the toner consumption amount, by using only black Bk and magenta M.

In this case, when there is a print mode exclusively used for two-color printing, the control becomes complex. Furthermore, the photoconductor driving motor is common to the colors of cyan, magenta, and yellow, and therefore when the photoconductor and the developing unit are controlled for only forming magenta images, the photoconductor and the developing unit of cyan and yellow also need to be controlled. In order to control these photoconductors and developing units, there is no need for image data, but there is a need for FGATE for monitoring the timing.

Therefore, by using "dummy FGATE", blank image data corresponding to cyan and yellow is created by the plotter control unit 200, FGATE of the same timing as regular printing is generated, and the photoconductors and the developing units are controlled.

Address 04: Dummy FGATE Sub Scanning Delay Amount Setting Register

An initial value of the timing adjustment counter used when the transmission of the frame synchronization signal MFSYNC to the controller 150 is masked, and the delay amount is to be matched with that of the color of data received from the controller 150.

Address 05: MFSYNC Main Scanning Output Position Setting Register

A value for fine-adjusting the timing of sending the frame synchronization signal MFSYNC to the controller 150.

Address 06: MFSYNC Output Enable Setting Register

Making a setting to enable the transmission of the frame synchronization signal MFSYNC to the controller 150.

The "MFSYNC output enable" function is used for completely invalidating the operations of colorplates other than black in a monochrome model, when the ASIC installed in the plotter control unit 200 is commonly used for a color model and a monochrome model.

Address 07: MLSYNC Output Number Setting Register

The value of the number of line synchronization signals MLSYNC to be sent to the controller 150 within one line.

Address 08: MLSYNC Main Scanning Offset Amount Setting Register

Data for fine-adjusting the timing of sending the line synchronization signal MLSYNC to the controller 150.

Address 09: MLSYNC Main Scanning Output Interval Register

Data for fine-adjusting the intervals of sending the line synchronization signal MLSYNC to the controller 150.

Address 10 is a register for the latch data read back trigger, and "1" is set by the CPU 160 according to need. Subsequently, the address 10 automatically returns to "0". When the latch data read back trigger becomes "1", the data in the latch data temporary saving area 2013 is overwritten in the CPU access data temporary saving area 2012. This may be referred to as a "third storage unit".

After sending a start trigger signal from the parameter control unit 201 to the video input unit 202, a STOUT signal is input from the video input unit 202. The STOUT signal is used as a latch signal, and the setting data stored in the registers having the addresses 01 through 09 of the CPU access data temporary saving area 2012 is overwritten (copied) and stored in the latch temps 01 through 09 of the latch data temporary saving area 2013. This is referred to as "latch".

The setting data that has been overwritten into the latch temps 01 through 09 of the latch data temporary saving area 2013 is overwritten and stored, by the latch data R/W control unit 2014, in a latch data storage area in the external memory 161, which has been selected by the latch select counter 2015.

The latch select counter 2015 increments the count every time a STOUT signal is input, and returns to "0" after "3".

The latch data R/W control unit 2014 selects a latch data storage area A0 of the external memory 161 when the latch select counter 2015 is indicating "0", selects A1 when "1", selects A2 when "2", and selects A3 when "3".

The setting values of the parameters temporarily saved in the latch temps 01 through 09 of the latch data temporary saving area 2013 are read by the video input unit 202 controlled by the CPU 160, and are applied to the image formation process of the page.

After the parameter setting values of the respective pages from page one to page four have been sequentially stored in the CPU access data temporary saving area 2012 by the CPU 160, the values are overwritten and saved in the latch data temporary saving area 2013 every time a STOUT signal is input.

The parameter setting values that have been temporarily saved in the latch data temporary saving area 2013, are applied to the image formation process of each page by the video input unit 202, and are sequentially overwritten (copied) and saved in the latch data saving areas A0 through A3 of the external memory 161.

Therefore, in the present embodiment, four pages worth of parameter setting values are stored in the latch data saving areas A0 through A3 of the external memory 161 that is the second storage unit.

Subsequently, at timings when the video input unit 202 applies the latch data, the latch data R/W control unit 2014 sequentially writes the data in the latch data saving areas A0 through A3 of the external memory 161, back in the latch data temporary saving area 2013. At this time, a latch reflect flag is sent from the latch data R/W control unit 2014 to the external memory 161.

When the latch select counter 2015 is indicating "0", the latch data R/W control unit 2014 selects the latch data saving area A0 of the external memory 161, selects A1 when "1", selects A2 when "2", and selects A3 when "3", and writes back the data.

The plotter control unit 200 including the parameter control unit 201 as described above and the external memory 161 are provided for each of a plurality of colors constituting a color image, i.e., for each of the colors of Y, M, C, and Bk. Therefore, the CPU access data temporary saving area 2012 that is the first storage unit, the latch data temporary saving area 2013, and the latch data saving areas A0 through A3 of the external memory 161 that are the second storage unit, are also provided for each of the colors.

The start trigger signal is a trigger signal common to the colors, sent by the CPU 160, and is asserted as the CPU 160 simultaneously sets "1" in the register having the address 00 in the CPU access data temporary saving area 2012 of the respective colors. When the start trigger signal is received, the timing control units 2021 of the video input units 202 of the respective colors simultaneously generate a STOUT signal, and one page worth of the setting values stored in the CPU access data temporary saving area 2012 of the respective colors are simultaneously latched in the latch data temporary saving area 2013. Furthermore, the data latched in the latch data temporary saving area 2013 is sequentially overwritten in the latch data saving areas A0 through A3 of the external memory 161, which is also simultaneously performed for the respective colors.

However, the timing of applying the setting data, temporarily saved in the latch data temporary saving area 2013 and the latch data saving areas A0 through A3 of the external memory 161, to the operations of the video input unit 202, is a timing starting from the time point when the frame synchronization signal MFSYNC of each color is asserted.

This function is realized by the wait time managing unit 21*c* (Wait Count0 ~Wait Count3) and the MFSYNC generating unit 21*b* "Wait Count Select" of the timing control unit 2021.

The data latch times are associated as "Wait Count0 and memory A0", "Wait Count1 and memory A1", "Wait Count2 and memory A2", and "Wait Count3 and memory A3". Here, the memories A0 through A3 are abbreviations of the latch data saving areas A0 through A3 in the external memory 161 illustrated in FIG. 5.

The "Wait Count Select" in the MFSYNC generating unit 21*b* is a 2 bit counter, and increments the count every time a STOUT signal is generated by the STOUT signal generating unit 21*a*. When the value reaches "3", the value returns to "0". This "Wait Count Select" and the latch select counter 2015 of the parameter control unit 201 are the same.

When the value of "Wait Count Select" is 0, "Wait Count 0" of the respective colors is operating.

When this value is 1, 2, and 3, "Wait Count 1", "Wait Count 2", and "Wait Count 3" operate, respectively.

Every time the STOUT signal generating unit 21*a* generates a STOUT signal, the value of "Wait Count Select" changes as 0→1→2→3→0 . . . .

The latch data R/W control unit 2014 illustrated in FIG. 5 refers to the value of the same latch select counter 2015 as the "Wait Count Select". Then, among the latch data saving areas 0 through 3 in the external memory 161, the memory matching the order of the referred value is selected, and the data latched in the latch data temporary saving area 2013 is overwritten.

At the time of applying, the associations of "Wait Count0 through Wait Count3" of the wait time managing unit 21*c* and "memories A0 through A3" of the external memory 161 are changed. At this time, the associations are as "Wait Count3 and memory A0", "Wait Count0 and memory A1", "Wait Count1 and memory A2", and "Wait Count2 and memory A3".

The latch data R/W control unit 2014 refers to the value of "Wait Count Select", and selects a memory matching the order of a value obtained by adding one to the referred value, from the memories A0 through A3 in the external memory 161. Then, the data stored in the selected memory is read, written back to the latch data temporary saving area 2013, and applied to the respective function units.

At the timing of latching and applying the parameter setting values, the associations of the "Wait Count0 through Wait Count3" of the wait time managing unit 21*c* and "memories A0 through A3" of the external memory 161 are shifted. Accordingly the R/W of the latch data saving areas A0 through A3 of the external memory 161 are prevented from overlapping.

Note that saving areas corresponding to the latch data saving areas A0 through A3 may be provided in the parameter control unit 201, instead of using the external memory 161. The latch data saving areas may be located anywhere, and the format is not limited.

Furthermore, only the process function unit such as the video input unit 202 of the plotter control unit 200 may be provided for each color; as for the CPU access data temporary saving area 2012 that is the first storage unit and the latch data temporary saving area 2013 and the latch data saving areas A0 through A3 that are the second storage unit, areas for the respective colors may be provided in a memory common to the colors.

Here, with reference to FIG. 6, a description is given of the latch timing and the apply timing of the data of the target register of the parameter setting values constituting the CPU access data temporary saving area 2012 of FIG. 5.

The latch timing is the timing when the data set and stored in the registers of the CPU access data temporary saving area 2012 is overwritten (latched) in the latch data temporary saving area 2013. The apply timing is the timing when the data latched in the latch data temporary saving area 2013 is applied to the operations of the video input unit 202. ON/OFF indicates the switching between ON (possible)/OFF (not possible) of the latch.

In the example illustrated in FIG. 6, only the data of the MFSYNC sub scanning delay amount setting register is latched by the STOUT signal immediately after setting the start trigger signal (Start Trigger), and is applied simultaneously. Then, the data becomes always on.

The data of the latch signal sub scanning delay amount setting register, the dummy FGATE delay generation enable setting register, the dummy FGATE sub scanning delay amount setting register, the MFSYNC main scanning output position setting register, the MFSYNC output enable setting register, the MLSYNC output number setting register, the MLSYNC main scanning offset amount setting register, and the MLSYNC main scanning output interval register, is latched by the STOUT signal immediately after a start trigger signal is set, and is applied by the assert of the frame synchronization signal MFSYNC of the corresponding page. The ON/OFF of the latch is possible.

As described above, the standard of selecting the register to be the target of latching immediately after a start trigger signal is set, is any one of the registers for saving the following parameter setting values.

- A parameter setting value used in the process function unit (video input unit 202) that operates immediately when the plotter control unit 200 receives a start trigger signal.
- A parameter setting value that is demanded to be set as soon as possible, because the value is used at the tip of the page.

A parameter setting value defining the interface with the controller 150, and a setting value having a setting timing that depends on an element other than the plotter control unit 200, such as the controller 150. In this case, this parameter setting value is referred to by the controller 150. Alternatively, the setting value is a signal that is exchanged with the controller 150. Specifically, the setting value is relevant to the frame synchronization signal MFSYNC and the line synchronization signal MLSYNC.

A parameter setting value that is demanded to be set as soon as possible because it is used by a plurality of (a wide range of) process function units immediately after the start trigger signal is received by the plotter control unit 200.

In the following, a description is given of the feature of the present embodiment.

By a start trigger signal, the plotter control unit 200 is able to perform a toggle operation of the image formation operation for a maximum of four pages.

Therefore, the external memory 161 can hold settings of parameters of a maximum of four pages.

The CPU 160 sets one page worth of the parameters for all colors, in the registers of the CPU access data temporary saving area 2012 of the respective colors, before the setting of the start trigger signal of the corresponding page.

The parameter setting values that have been set in the registers of the CPU access data temporary saving area 2012 for all of the colors are latched in the latch data temporary saving area 2013 for the respective colors, after a start trigger signal common to the colors of the page is sent, and at the time when the STOUT signal is asserted.

Among the parameter setting values of the respective colors that have been latched, only the MFSYNC sub scanning delay amount setting data is immediately applied to the operations of the internal modules of the video input unit 202. The other parameter setting values are applied to the operations of the internal modules of the video input unit 202 when the frame synchronization signal MFSYNC of each color of the corresponding page is asserted.

After the start trigger signal is input in the plotter control unit 200, a STOUT signal is generated inside, and until this is negated (approximately 1 ms), a new parameter cannot be set in the register of the CPU access data temporary saving area 2012.

The register of the CPU access data temporary saving area 2012 can be switched between latch ON/OFF (initial value: ON). When the setting is latch OFF, the parameter setting values set by the CPU 160 are applied to the image generation in a real-time manner.

When an abnormality occurs in the function units for generating a line synchronization signal MLSYNC and an external trigger signal STIN_N, a STOUT signal cannot be normally generated, and an abnormality occurs in the latch operation. Thus, a separate trigger signal exclusively used for latch setting for latching the parameters, or an external trigger signal exclusively used for latch setting, may be sent immediately before the start trigger signal, to set the latch signal. This trigger signal exclusively used for latch setting is a trigger signal exclusively used for parameter setting.

The start trigger signal and the trigger signal exclusively used for latch setting may be generated by having the CPU 160 change the value of the parameter setting. Alternatively, the start trigger signal and the trigger signal exclusively used for latch setting may be generated by having the CPU 160 change the signal state in the input terminal of the plotter control unit 200 that is a write control unit.

When a connection is made with the system activated by a trigger for each image formation color, and not the start trigger signal, one page worth of the parameter setting values are held. These values are latched by an assert edge of the frame synchronization signal MFSYNC, and are applied to the image formation of the page.

In order to recognize the connection with the system activated by a trigger for each image formation color, there is a method of setting a mode by an external terminal, referring to a system mode setting parameter set by the CPU 160, and adding a condition of recognizing the trigger activation to the parameters of the ON/OFF setting of latch.

When an abnormal ending occurs, the latch select counter 2015 illustrated in FIG. 5 is reset. Thus, at the time of recovering, the CPU 160 is to set the same parameters as those before starting to print the first page, in each of the registers of the CPU access data temporary saving area 2012.

However, when the image writing is interrupted due to a paper jam or an abnormality in the machine occurring during the printing, the values set in the registers of the CPU access data temporary saving area 2012 and the data saved in the latch data temporary saving area 2013 applied to the image generation, become different. Thus, it is difficult to analyze the operation when the image writing is interrupted. Accordingly, there is a function by which the CPU 160 sets "1" in the latch data read back trigger, and the data saved in the latch data temporary saving area 2013 is overwritten in the CPU access data temporary saving area 2012, such that the CPU 160 can read and refer to this data.

A description is given of a maximum number of pages that can be held in the image formation unit.

The maximum number of pages that can be held in the image formation unit is determined by the number of pages that can be arranged in the interval from the leading image formation color to the last image formation color (the maximum inter-drum distance between the photoconductive drums 110*a* and 104*a* illustrated in FIG. 2) in a tandem color image forming apparatus.

Number of pages that can be arranged=maximum inter-drum distance/(sheet size+sheet interval) (as the sheets used for printing become smaller, such as a postcard and a business card, the number of pages that can be arranged increases)

For example, when the maximum inter-drum distance is 450 mm, the sheet size is 100 mm (a small sheet such as a postcard), and the sheet interval is 50 mm, the number of pages that can be arranged is three.

When the number of pages that can be arranged is three, the leading colors up to the third page are retained on the intermediate transfer belt, and images of the leading color (Y) of the fourth page and the last color (Bk) of the first page are simultaneously formed. Accordingly, there is a need to hold parameter setting values for the number of pages that can be arranged+one page. Thus, there is a need to set the number of pages that can be held in the second storage unit, to be the number of pages that can be arranged+one page.

Therefore, the second storage unit needs to have a storage capacity corresponding to the storage capacity of the first storage unit multiplied by greater than or equal to a number of pages that is one more page than the number of pages that can be arranged between the leading image formation color and the last image formation color.

Furthermore, the plotter control unit 200 performs a toggle operation on the selection of the parameter setting values, corresponding to the number of pages that can be held in the second storage unit. The number of times of switching by the toggle operation is preferably an Nth power of 2 (N being a natural number). Thus, the number of pages that can be held in the second storage unit is to be greater than the number of pages that can be arranged+1 and the minimum Nth power of 2 (N being a natural number). Therefore, when the number of pages that can be arranged+1 is four, the value becomes $2^2=4$.

That is, the second storage unit preferably has a storage capacity corresponding to a storage capacity of the first storage unit multiplied by an Nth power of 2 (N being a natural number).

Therefore, the second storage unit preferably has a storage capacity corresponding to a storage capacity of the first storage unit multiplied by a value, which is greater than a number of pages that is one more page than a number of pages that can be arranged in the image formation unit and which is an Nth power of 2 (N being a natural number) that is closest to the number of pages that is one more page than the number of pages that can be arranged in the image formation unit.

When a connection is made with the system activated by a trigger for each image formation color, and not the start trigger signal, the number of pages that can be held in the second storage unit may be one page.

In parameter control in a conventional register (including a double register), the values of the parameters set in the respective registers are used for image formation of different pages between the colors at the print start timing of each color. Therefore, the registers necessary for image formation have to be controlled separately, by different addresses for the respective colors.

In the above described system according to an embodiment of the present invention, the parameter setting values are applied to the image formation operation by managing the timings for the respective pages and the respective colors, and therefore, until the setting values are held, it is only necessary to manage in units of pages, and the parameters can be common to the respective colors. Accordingly, it is possible to reduce the number of addresses necessary for communicating with the CPU.

Thus, by using a register managed by one address (the latch data temporary saving area 2013 and the external memory 161), one page worth of the parameters of all colors are stored in the register (CPU access data temporary saving area 2012) at the same time as the setting of a start trigger common to all image formation colors. When the next start trigger is set, the parameters of the next page are stored while maintaining the storage of parameters of the previous page. A plurality of pages worth of the parameter setting values can be stored, and the parameter setting values are automatically applied to write control for one page and one color at a time at the image formation start timings of the respective colors of the page.

In this invention, there is no distinction between color and monochrome, and is thus an effective technology for high-speed image forming. This is because, in order to realize high-speed image forming, the timings of parameter setting need to be severely controlled.

An example of color image forming is described in the above embodiment, because in the case of color images, there is a need to set parameters for four colors for image forming of one page, and is thus particularly effective in that the degree of severity in parameter setting is higher than the case of monochrome printing.

In monochrome image forming also, parameter setting is severe in a high-speed machine, and therefore the present invention becomes effective.

In the case of an image forming apparatus exclusively used for monochrome printing, the plotter control unit 200 that is the write control unit only needs one channel. Therefore, it is only necessary to provide one set of the CPU access data temporary saving area 2012 that is the first storage unit, and the latch data temporary saving area 2013 and the latch data saving areas A0 through A3 that are the second storage unit.

[Write Control Method]

A write control method according to an embodiment of the present invention is performed by a write control unit (plotter control unit 200) controlled by a arithmetic control unit (CPU 160) for receiving one page worth of image data, performing various processes on the received image data by process function units (video input unit 202), controlling an exposure unit according to the processed image data, and writing an image by exposing a photoconductor. The write control method includes the following steps (1) through (3).

(1) A step of generating, by the arithmetic control unit (CPU 160), setting values of various parameters used by the process function units such as the video input unit 202 and storing the generated setting values in a first memory CPU access data temporary saving area 2012;

(2) a step of sending, by the arithmetic control unit, a trigger signal indicating start of image formation to the write control unit (plotter control unit 200), and repeating to store, in a second memory (latch data temporary saving area 2013 and A0 through A3), the setting values of the parameters stored in the first memory, to store a plurality of pages worth of the setting values in the second memory; and (3) a step of applying the setting values of a desired page among the plurality of pages worth of the setting values stored in the second memory, to operations by the process function units (video input unit 202, etc.) when the write control unit writes an image of the desired page. The embodiments of this write control method are sufficiently described in the embodiments of the write control apparatus of the image forming apparatus described above.

[Program]

A program according to an embodiment of the present invention causes a computer (CPU 160) for controlling the above write control apparatus to execute the following procedures (1) through (3):

(1) a procedure of generating setting values of various parameters used by the process function units such as the video input unit 202 and storing the generated setting values in a first memory CPU access data temporary saving area 2012;

(2) a procedure of sending, by the arithmetic control unit, a trigger signal indicating start of image formation to the write control unit (plotter control unit 200), and repeating to store, in a second memory (latch data temporary saving area 2013 and A0 through A3), the setting values of the parameters stored in the first memory, to store a plurality of pages worth of the setting values in the second memory; and (3) a procedure of applying the setting values of a desired page among the plurality of pages worth of the setting values stored in the second memory, to operations by the process function units (video input unit 202, etc.) when the write control unit writes an image of the desired page. The embodiments of this write control method are sufficiently described in the embodiments of the write control apparatus of the image forming apparatus described above.

In the above embodiments, this program can be stored, in advance, in a program ROM constituting the CPU (microcomputer) 160 that is an arithmetic control means. Alternatively, this program may be stored in a portable memory such as a CD-ROM, and may be loaded in a computer of the image forming apparatus, or may be downloaded through a network.

The embodiments of the present invention are described above; however, the present invention is not so limited. The present invention may be applied to a monochrome image forming apparatus, and an intermediate transfer drum may be used instead of an intermediate transfer belt in the case of a color image forming apparatus, and a method of transferring an image by directly sequentially superimposing toner images of the respective colors onto a recording medium (direct transfer method) may be used. The photoconductor is not limited to a drum type; the photoconductor may be a belt type. The secondary transfer member is not limited to a belt; a transfer member that is a drum type or a roller type may be used. The types and numbers of colors may be arbitrarily changed.

Furthermore, the image forming apparatus to which the present invention is applied is not limited to a printer; a printing apparatus, a copier, a fax machine, and a multifunction peripheral including a plurality of these functions may be used.

The configurations and functions of the above embodiments may be appropriately added, changed, and partially omitted, and may be arbitrarily combined unless they do not contradict with each other.

According to one embodiment of the present invention, a write control apparatus, an image forming apparatus, and a write control method are provided, which are capable of setting a plurality of pages worth of parameters in advance, and setting parameters quickly and reliably for each of the pages for which image formation is to be performed, while maintaining the productivity, with a simple system without using active signals or interrupt signals.

The write control apparatus, the image forming apparatus, and the write control method are not limited to the specific embodiments described herein, and variations and modifications may be made without departing from the spirit and scope of the present invention.

The present application is based on and claims the benefit of priority of Japanese Priority Patent Application No. 2014-189298, filed on Sep. 17, 2014, the entire contents of which are hereby incorporated herein by reference.

What is claimed is:

1. A write control apparatus for receiving one page worth of image data, performing various processes on the received image data, controlling an exposure unit according to the processed image data, and writing an image by exposing a photoconductor, the write control apparatus comprising:

a write controller configured to include an image processor to perform the processes;

a computer configured to generate setting values of various parameters used by the image processor, and to control the write controller;

a first memory configured to store the setting values of the parameters generated by the computer; and a second memory configured to store one page worth of the setting values of the parameters stored in the first memory, and configured to store a plurality of pages worth of the setting values, wherein when the computer sends a trigger signal indicating start of image formation to the write controller, the second memory stores one page worth of the setting values stored in the first memory, and the setting values of a desired page among the plurality of pages worth of the setting values stored in the second memory are applied to operations by the image processor when the write controller controlled by the computer writes an image of the desired page.

2. The write control apparatus according to claim 1, wherein the setting values stored in the first memory and the second memory are setting values used by the image processor that operates when the write controller receives the trigger signal.

3. The write control apparatus according to claim 1, wherein the setting values stored in the first memory and the second memory are setting values used in a tip of a page.

4. The write control apparatus according to claim 1, wherein the setting values stored in the first memory and the second memory are setting values that define an interface with an image controller which sends the one page worth of the image data.

5. The write control apparatus according to claim 1, wherein the setting values stored in the first memory and the second memory are setting values that are used by a plurality of the image processors in the write controller after the write controller receives the trigger signal.

6. The write control apparatus according to claim 1, wherein the write controller, the first memory, and the second memory are provided for each of a plurality of colors constituting a color image, and the trigger signal is a start trigger signal common to the plurality of colors, sent by the computer.

7. The write control apparatus according to claim 1, wherein the write controller, the first memory, and the second memory are provided for each of a plurality of colors constituting a color image, and the trigger signal is a trigger signal exclusively used for parameter setting common to the plurality of colors, sent by the computer before sending a start trigger signal common to the plurality of colors.

8. The write control apparatus according to claim 6, wherein the write control apparatus is for performing tandem color image forming, and the second memory has a storage capacity corresponding to a storage capacity of the first memory multiplied by greater than or equal to a number of pages that is one more page than a number of pages that can be arranged between a leading image formation color and a last image formation color.

9. The write control apparatus according to claim 1, wherein the second memory has a storage capacity corresponding to a storage capacity of the first memory multiplied by an Nth power of 2 (N being a natural number).

10. The write control apparatus according to claim 1, further comprising:

an image formation unit configured to form the image, wherein the second memory has a storage capacity corresponding to a storage capacity of the first memory multiplied by a value, which is greater than a number of pages that is one more page than a number of pages that can be arranged in the image formation unit and which is an Nth power of 2 (N being a natural number) that is closest to the number of pages that is one more page than the number of pages that can be arranged in the image formation unit.

11. The write control apparatus according to claim 1, wherein, when writing the image is interrupted, the write controller stores back the setting values which have been applied to the operations by the image processor for the writing-interrupted image in the first memory from the second memory, and the stored-back setting values can be referred to by the computer.

12. A write control method performed by a write controller controlled by a computer for receiving one page worth of image data, performing various processes on the received image data by an image processor, controlling an exposure unit according to the processed image data, and writing an image by exposing a photoconductor, the write control method comprising:

generating, by the computer, setting values of various parameters used by the image processor and storing the generated setting values in a first memory;

sending, by the computer, a trigger signal indicating start of image formation to the write controller, and repeating to store, in a second memory, one page worth of the setting values of the parameters stored in the first memory, to store a plurality of pages worth of the setting values in the second memory; and applying the setting values of a desired page among the plurality of pages worth of the setting values stored in the second memory, to operations by the image processor when the write controller writes an image of the desired page.

13. An image forming apparatus comprising:

the write control apparatus according to claim 1.

14. An image forming apparatus comprising:

the write control apparatus according to claim 6; and a tandem color image formation unit.

15. A write control apparatus for receiving one page worth of image data, performing various processes on the received image data, controlling an exposure unit according to the processed image data, and writing an image by exposing a photoconductor, the write control apparatus comprising:

a write controller configured to include an image processor to perform the processes;

a computer configured to generate setting values of various parameters used by the image processor, and to control the write controller;

a first memory configured to store the setting values of the parameters generated by the computer; and a second memory configured to store one page worth of the setting values of the parameters stored in the first memory, wherein when the computer sends a trigger signal indicating start of image formation to the write controller, the second memory stores one page worth of the setting values stored in the first memory, and the setting values of a desired page stored in the second memory are applied to operations by the image processor when the write controller controlled by the computer writes an image of the desired page.

* * * * *